US008408620B2

(12) United States Patent
Gruppioni

(10) Patent No.: US 8,408,620 B2
(45) Date of Patent: Apr. 2, 2013

(54) DEVICE HAVING A HANDGRIP FOR TRANSPORTING CONTAINERS

(76) Inventor: Giogio Gruppioni, Formigini (IT)

( * ) Notice: Subject to any disclaimer, the term of this patent is extended or adjusted under 35 U.S.C. 154(b) by 0 days.

(21) Appl. No.: 13/256,681

(22) PCT Filed: Mar. 11, 2010

(86) PCT No.: PCT/EP2010/053144

§ 371 (c)(1),
(2), (4) Date: Sep. 15, 2011

(87) PCT Pub. No.: WO2010/105968

PCT Pub. Date: Sep. 23, 2010

(65) Prior Publication Data

US 2012/0024874 A1 Feb. 2, 2012

(30) Foreign Application Priority Data

Mar. 16, 2009 (IT) ..... BO2009A0150

(51) Int. Cl.

| | |
|---|---|
| ***B65D 33/00*** | (2006.01) |
| ***B65G 7/12*** | (2006.01) |
| ***A45F 5/00*** | (2006.01) |

(52) U.S. Cl. ..... 294/149; 294/165

(58) Field of Classification Search ..... 294/27.1, 294/145, 149, 151–156, 165; 229/117.23; 383/10

See application file for complete search history.

(56) References Cited

U.S. PATENT DOCUMENTS

| | | | | |
|---|---|---|---|---|
| 3,016,133 | A * | 1/1962 | Jones | 206/229 |
| 5,180,894 | A * | 1/1993 | Quick et al. | 219/730 |
| 5,409,282 | A * | 4/1995 | Bale | 294/152 |
| 5,524,949 | A * | 6/1996 | Mooney | 294/149 |
| 6,298,992 | B1 * | 10/2001 | Tsao | 206/549 |
| 7,055,876 | B2 * | 6/2006 | Woldekidan | 294/152 |
| 7,591,496 | B1 * | 9/2009 | De Beck | 294/152 |
| 2004/0164575 | A1 * | 8/2004 | Francario | 294/156 |

* cited by examiner

*Primary Examiner* — Dean Kramer
(74) *Attorney, Agent, or Firm* — William J. Sapone; Coleman Sudol Sapone P.C.

(57) ABSTRACT

A device for transporting containers includes a band (2) of limp material which is closed in a loop and which is joined at a transversal strip (3) defined by respective opposite end edges (2A, 2B). A slot is provided in a median position in the strip (3) for defining a handgrip (M), the band (2) being adapted to wrap around and support at least one container, such that the strip (3) is arranged at an upper and practically central position with respect to the container. The device can be provided with blocking structures (4) for preventing exit of the container from open sides thereof.

2 Claims, 3 Drawing Sheets

DEVICE HAVING A HANDGRIP FOR TRANSPORTING CONTAINERS

TECHNICAL FIELD

The invention relates to the field of articles provided by retailing stores to their customers for facilitating transport of products that have been sold.

BACKGROUND ART

From among these articles one of the most used is the classic plastic bag, in various formats; also very widely used are paper, carton or synthetic bags, designed to contain articles of clothing, shoes or other objects packed in relative boxes.

All of these articles exhibit handles, variously conformed, which are designed to enable a user to transport the load easily by suspension instead of having to hold the article directly using one or both hands placed underneath.

The bags referred-to above are very liable to customization and therefore become effective publicity vehicles, such that supply of them, often free of charge, represents not only an act of courtesy towards the customer but also a form of promotion for the store or marks of products sold by the store.

Loose or packed products can be inserted in the bags; excluded from the products that can be placed therein are articles having considerable horizontal dimensions and which require being held in a horizontal orientation.

A first example of this is the cardboard box supplied for take-away pizzas, which in order to be transported, whether single or stacked, have to be held from below, not without some discomfort due to the heat emanated to the carton from the contents and with the risk that an awkward action or unexpected contact with obstacles might cause the carton to be dropped.

A further example relates to large-format trays used for pastry or fresh pasta asciutta products, which are packed carefully such as not to crush the contents and which must thereafter be handled with care by the customer in order to prevent damage thereto.

To the difficulty of transporting objects by holding them from below can be added other objective difficulties, in particular when the equilibrium provided by a single hand is precarious and other actions have to be performed, such as taking out keys, opening doors or other like maneuvers.

SUMMARY OF THE INVENTION

The aim of the present invention is therefore to provide a device having a handgrip for transporting containers, conformed in such a way as to be particularly suitable for the above-cited containers, either single or stacked, which exhibit considerable horizontal dimensions and which necessarily require carrying horizontally disposed.

A further aim of the invention relates to the desire to provide a device which is easy to set up for use and which is easily removable at the conclusion of the transport operation.

A still further aim of the invention consists in providing a device destined to be realised in a format and to be provided with such details as to guarantee secure engagement with the specific container to which it is destined.

A further aim of the invention is to obtain a device which can easily be customized by means of printing of marks, logotypes, writings and the like.

A still further aim of the invention consists in providing a device which can be realized at low cost, even while employing materials suitable for food use.

BRIEF DESCRIPTION OF THE DRAWINGS

The characteristics of the invention will more clearly emerge from the following description of a preferred embodiment of the device, in agreement with what is set out in the claims and with the aid of the accompanying figures of the drawings, in which:

BEST MODE FOR CARRYING OUT THE INVENTION

Figure 2:
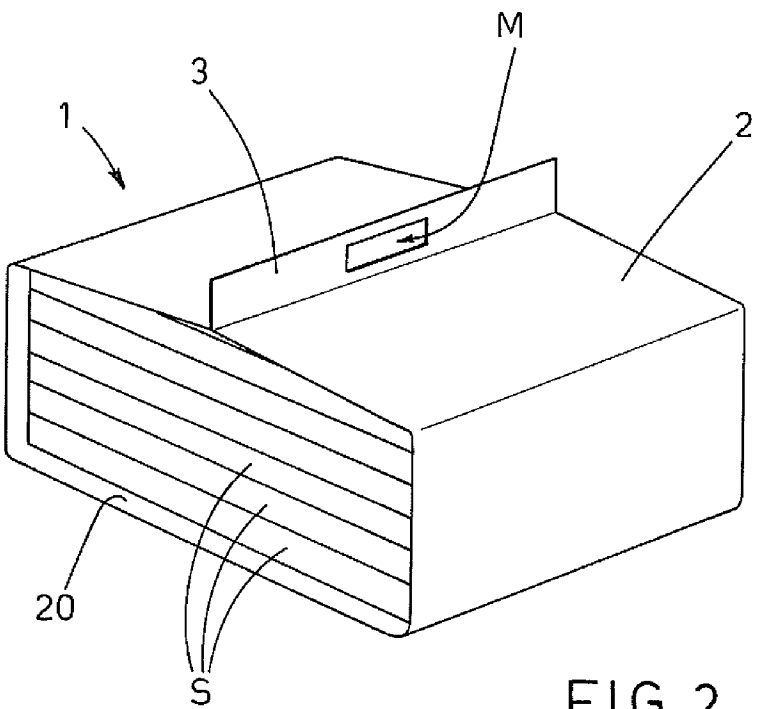
FIG. 2 is a perspective view illustration of the device of FIG. 1 in an operative condition.

With reference to the figures of the drawings, 1 denotes the device of the invention in its entirety.

The device 1 is constituted by a band 2 of limp material, closed in a loop and joined at a transversal strip 3 defined by opposite end flaps 2A, 2B.

The band 2 can advantageously realized using material suitable for joining by means of heat-welding or ultrasound welding; in the case of devices 1 destined for the food sector, certified non-toxic materials are used.

The transversal strip 3 is provided at a centre thereof with a slot 30 destined to define a handgrip M.

The width and length of the band 2 are established as a function of the dimensions and number of containers to be transported; in a preferred embodiment, the width of the band 2 is always greater than a corresponding dimension of the relative container, for reasons which will become clearer herein below.

To place the device 1 in operative conditions, the band 2, via lateral insertion, is wound about the container or stack of containers, taking care that any leftover band 2 in terms of width is equally distributed over the two sides to define two edges 20, and that the strip 3 is positioned superiorly and in a practically central position with respect to the container or the stack.

It is easy to understand that the transport is effected by gripping the handle M with a single hand, thus bearing the container or stack thereof, in a horizontal position.

The device 1 can be predisposed for prismatically-shaped containers; in this case, the shape, having many corners, and the weight, determine in the corresponding zone of the band 2 a slight deformation which creates a sort of pocket, delimited in the two sides opened by the edges 20, in which the container is partially inserted such that it is prevented from exiting laterally.

Figure 1:
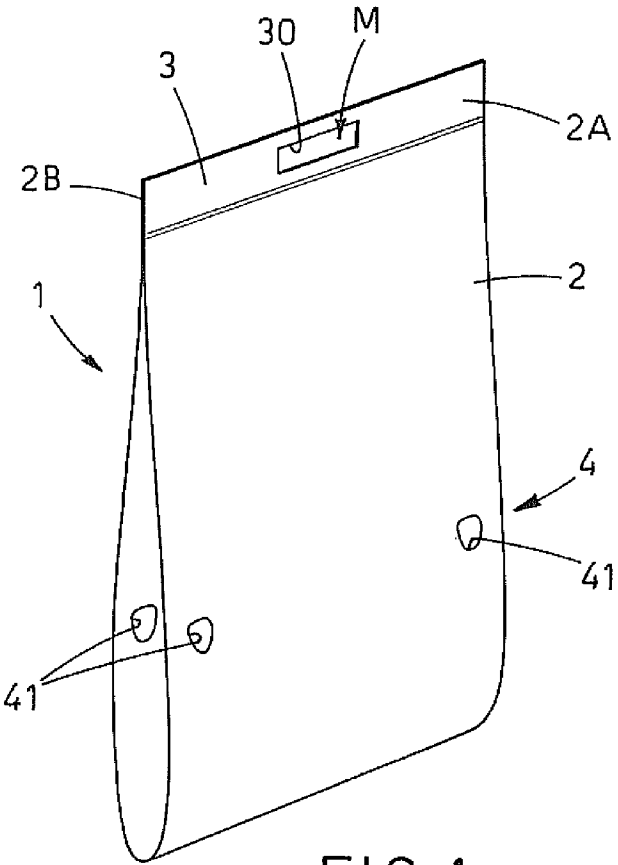
FIG. 1 is a perspective view illustration of the device of the invention, predisposed for a type of container, in a non-operative condition.
Figure 3:
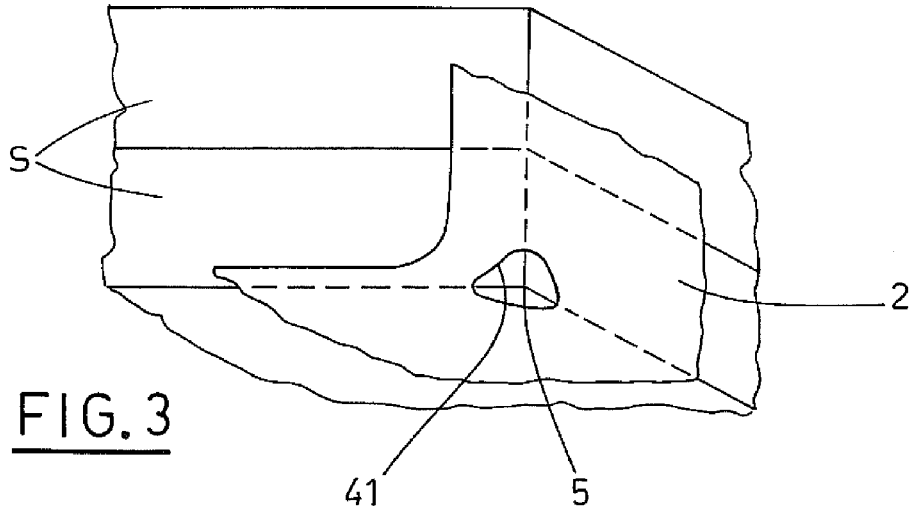
FIG. 3 is an enlarged-scale representation of a constructional detail of the device of FIGS. 1 and 2.

In example illustrated in FIGS. 1, 2 and 3, the band 2 is of such dimensions as to wind about a stack of boxes S of flattened prismatic shaped, of a type such as cartons provided for take-away pizzas; in the particular case, the first box S is retained and this is sufficient to block the whole stack, as the boxes S themselves are already provided with blocks for mutually retaining the boxes when stacked.

For greater security against exit of the container or stack thereof, the device 1 can advantageously be provided with blocking means 4.

In the device that is predisposed for prismatic containers, such as in the above example, the blocking means 4 are constituted by holes 41, which are suitably positioned in the band 2 (FIG. 1), destined to be engaged by the lower corners 5 of the corresponding container (the first box S in the example), preventing the lower corners 5 from making movements towards the open sides (FIG. 3).

The device 1 can be predisposed for containers or packs having rounded shapes, for example wrapped trays V containing pastry products, fresh pasta asciutta or the like.

Figure 4:
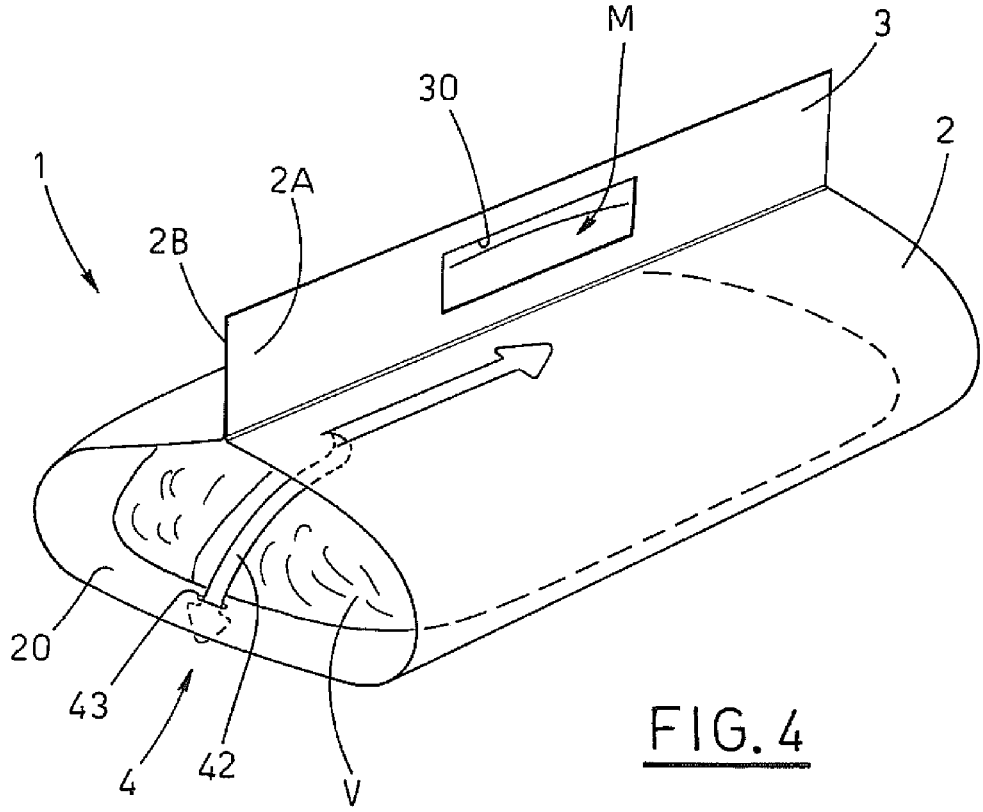
FIG. 4 is a perspective view illustration of the device predisposed for a further type of container in an operative condition.

FIG. 4 illustrates a first constructional variant in which the blocking means 4 are constituted by two shaped straps 42 which are arranged symmetrically (of which only one is visible in the figure), and which are obtained by die cutting and shaping of the material the band 2 is made of.

In a known way, the cuts of the shaping operations are partial, such that the straps 42 remain constrained to the band 2 when the device 1 is manufactured.

After having inserted the wrapped tray V, the straps 42 are detached, where this is required, are folded and inserted in corresponding slits 43 specially afforded in the edges 20; in this way the tray V is prevented from exiting (see FIG. 4 once more).

Figure 5:
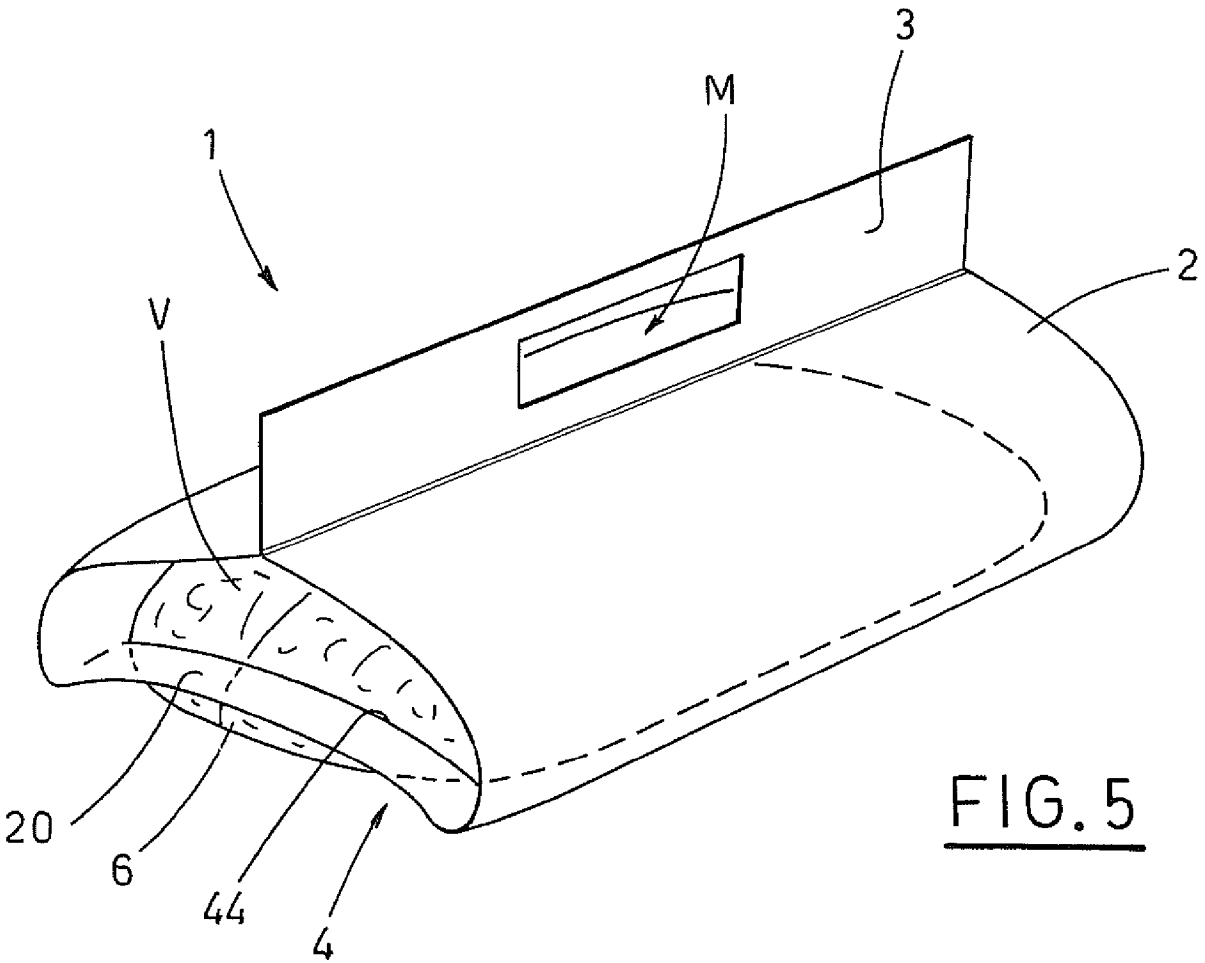
FIG. 5 is a perspective view illustration of a further embodiment of the device for a container as illustrated in FIG. 4.

FIG. 5 illustrates a second constructional variant in which the blocking means 4 are constituted by two cuts 44 of a suitable length, realised symmetrically in the band 2 in proximity of the edges 20, which thus are partially detached from the band 2.

After having inserted the wrapped tray V, the edges 20 are raised and the corresponding flanks 6 of the tray V are introduced into the slits that have been created; also in this way the tray V is prevented from exiting (see also FIG. 5).

From the above description the peculiarities of the device 1 emerge clearly. When opportunely dimensioned, thanks to the handgrip M the device 1 enables comfortable transport with the load suspended of all containers, either single or stacked, which exhibit considerable horizontal dimensions, and which necessarily require being held horizontally and which cannot be introduced into normal bags.

Obviously the device 1 of the invention might be used, alternatively to bags, even where the special circumstances outline above do not exist. The setting-up of the device, as well as its removal, is simple, rapid and can be easily done by a single person without disturbing the horizontal lie of the container.

The device can be effectively customised by printing of marks, logotypes, writings and the like, such as to become an effective vehicle for publicity.

The conformation of the device enables all the format variants to be realized very economically, and the described blocking means also can be obtained at practically zero cost, such that the invention can be marketed at an inexpensive cost which is certainly in line with its use value.

The above characteristics remain true, except for possibly different costs of materials, also when certified non-toxic materials for food use are used for realizing the device 1.

It is however clear that the above is given by way of non-limiting example, and any modifications to details thereof, for example the blocking means, are considered henceforth to fall within the ambit of protection as defined in the following claims.

The invention claimed is:

1. A device provided with a handgrip for transporting containers comprising:

a band (2) of limp material which is closed in a loop and which is joined at a transversal strip (3) defined by respective opposite end edges (2A, 2B);

a slot (30) which is afforded in a median position in the strip (3) and which defines the handgrip (M), the band (2) being adapted to wrap around and support at least one container, such that the strip (3) is arranged at an upper and practically central position with respect to the container, blocking means (4) being provided for retaining the container during transport thereof and to prevent the container from falling out from open sides thereof, the device being adapted for use with rounded containers, wherein the blocking means (4) are constituted by at least two shaped straps (42), which are symmetrically arranged and which are obtained by die cutting a material of which the band (2) is made, and which are intended to be folded and inserted, after introduction of the container into the band (2), into corresponding slits (43) provided in the edges (20) of the band and which are adjacent to the container at the open sides.

2. The device according to claim 1, characterized in that the band (2) exhibits a greater width than a corresponding dimension of the container, such that after the container is introduced into the band, edges (20) are defined at two open sides thereof.

* * * * *